US006981399B1

(12) United States Patent
Nybo et al.

(10) Patent No.: US 6,981,399 B1
(45) Date of Patent: Jan. 3, 2006

(54) METHOD FOR DETECTING A DIFFERENTIAL PRESSURE

(75) Inventors: Peter Jungklas Nybo, Randers (DK); Lasse Ilves, Helsinki (FI); Heikki Yli-Korpela, Vantaa (FI)

(73) Assignee: Grundfos A/S, (DK)

( * ) Notice: Subject to any disclaimer, the term of this patent is extended or adjusted under 35 U.S.C. 154(b) by 0 days.

(21) Appl. No.: 10/670,953

(22) Filed: Sep. 25, 2003

(30) Foreign Application Priority Data

Sep. 26, 2002 (EP) ..... 02021526

(51) Int. Cl.
*G01F 29/00* (2006.01)

(52) U.S. Cl. ..... 73/1.73

(58) Field of Classification Search ..... 73/1.57, 73/1.59, 1.62, 1.63, 1.69, 1.71, 1.73, 1.64, 73/1.66, 1.67; 417/38, 278
See application file for complete search history.

(56) References Cited

U.S. PATENT DOCUMENTS 4,297,081 A * 10/1981 Irvin ..... 417/2
4,476,707 A * 10/1984 Burns et al. ..... 73/861.52
4,744,244 A * 5/1988 Tanaka ..... 73/115
4,867,871 A * 9/1989 Bowne ..... 210/97
5,553,481 A * 9/1996 Arai ..... 73/1.66

FOREIGN PATENT DOCUMENTS

DE 1609092 3/1970
WO WO 9721988 6/1997

* cited by examiner

*Primary Examiner*—Robert Raevis
(74) *Attorney, Agent, or Firm*—Jacox Meckstroth & Jenkins

(57) ABSTRACT

The invention relates to a method for detecting a differential pressure or for correcting a pressure value detected in the fluid on the basis of a pressure of a surrounding medium, wherein at a first point in time the pressure of the surrounding medium is detected and at a later, second point in time the pressure of the fluid is detected, and the pressure value detected in the fluid is corrected on the basis of the pressure of the surrounding medium. The invention furthermore relates to a pump system with a level sensor in which this method is applied, as well as to the use of a pressure sensor in such a pump system.

19 Claims, 1 Drawing Sheet

METHOD FOR DETECTING A DIFFERENTIAL PRESSURE

BACKGROUND OF THE INVENTION

The invention relates to a method for correcting a pressure value detected in a fluid on the basis of a pressure of a surrounding medium, as well as to a pump system with a level sensor and to the use of a pressure sensor in a corresponding pump system.

Submersible pumps are usually equipped with a level sensor or a level switch which switches the pump on and off in dependence of the fluid level in the pump sump. With this pressure sensors may be used as level sensors which detect the fluid pressure. Since the fluid pressure changes in dependence on the height of the fluid level above the pressure sensor, by way of the fluid pressure one may determine the liquid level and accordingly switch the pump on and off. With this however it is a problem that changes of the atmospheric pressure likewise have an effect on the detection by the pressure sensor. Thus when determining the fluid level inaccuracies occur due to fluctuations in the pressure of the surroundings. In order to compensate these, in the past differential pressure sensors have been applied as pressure sensors which determine the pressure difference between a fluid pressure and the pressure of the surroundings and thus permit the exact height of the fluid level above the pressure sensor to be determined. The application of these sensors however demands a tube or a flexible tubing to be led out of the pump sump in order to also be able to impinge the pressure sensor with the pressure of the surroundings. This renders the construction and the assembly of such pumps quite complicated.

BRIEF SUMMARY OF THE INVENTION

It is therefore the object of the invention to provide an improved method for correcting a pressure value detected in a fluid on the basis of a pressure of a surrounding medium, as well as a corresponding pump system which permit a simplified construction of the pump system.

This object is achieved by a method with the features of detecting a differential pressure or for correcting a pressure value detected in a fluid on the basis of another pressure, wherein at one point in time one detects a first pressure and another point in time a second pressure, and the second pressure is corrected on the basis of the first pressure. The object may also be achieved by a pump system with a level sensor which comprises a pressure sensor for determining an absolute pressure, and a control means which switches the pump on and/or off in dependence on the readings of the level sensor, wherein the pump comprises a calibration means which controls the pump such that for calibration a fluid level is lowered below the level of the pressure sensor so that this detects the pressure of the surroundings as well as by the use of a pressure sensor with the features of a pressure sensor impinged on one side in a pump system, wherein the pressure sensor only has electrical connection conduits.

Other preferred embodiment forms are to be deduced from the accompanying dependent claims.

The method according to the invention serves for correcting a pressure value detected in a fluid on the basis of the pressure of a surrounding medium, wherein with this, there is formed a pressure difference between a first pressure value and a second pressure value, for example, of the surrounding medium. According to the invention at one point in time a first pressure value and at another point in time a second pressure value is detected. Subsequently the second pressure value is corrected on the basis of the first pressure value, wherein preferably a pressure difference between the two detected pressure values is evaluated. This method according to the invention thus allows a pressure sensor to detect absolute values only, but at two different points in time, in order to determine a pressure difference. Thus a differential pressure sensor which is impinged on two sides may be done away with. The method according to the invention permits the evaluation of a pressure difference with a sensor impinged on one side. This has the further advantage that in such a sensor which usually comprises a membrane, the detection electronics may be arranged on a side of the membrane which is not impinged by pressure. This simplifies the insulation or sealing of the electronics with respect to the fluid in which the pressure is to be determined. A simplified sensor construction is thus possible.

The method according to the invention may be applied comprehensively wherever a differential pressure is to be determined or a measured pressure value is to be preferably continuously corrected on the basis of a further pressure value. The method may for example be applied in order to determine a differential pressure in a closed system or in order to continuously correct a pressure value measured in a fluid on operation of an installation, on the basis of a pressure of a surrounding medium. At the same time for example one may firstly determine the pressure of the surrounding medium and then at a second later point in time the pressure of the fluid may be determined and the latter may be corrected then on the basis of the pressure of the surroundings by forming the differential pressure. Alternatively to this one may firstly determine the fluid pressure, and subsequently the pressure of the surroundings.

There is provided at least one pressure sensor serving as a level sensor in a submersible pump and at the one point in time the pressure of the surroundings and at the other point in time the pressure of the fluid to be delivered by the pump is detected. This embodiment of the method permits the design of a simplified level sensor for a pump. It is no longer necessary to apply a pressure sensor impinged on both sides which is simultaneously impinged by the pressure of the surroundings and by the pressure of the fluid to be delivered, and to determine the height of the fluid level via the measured differential pressure. According to the invention one may apply a pressure sensor impinged on one side, wherein the pressure of the surroundings and the pressure of the fluid to be delivered by the pump may be determined at two different points in time. This method may preferably be used where pressure changes of the surroundings occur slowly. This is the case with pumps, since the atmospheric pressure of the surroundings changes relatively slowly whilst the pressure of the fluid to be delivered may rapidly change due to the rapid changes of the fluid level. Due to the slow changes of the pressure of the surroundings a continuous detection of the pressure of the surroundings for correcting the fluid pressure is not necessary. It is sufficient to detect the pressure of the surroundings at predefined points in time and subsequently to correct the continuously determined fluid pressure by this previously detected value. The detection of the pressure of the surroundings and of the pressure of the fluid to be delivered may for example be effected by one and the same sensor. For this the sensor may be connected to the fluid and the surrounding medium or to the surroundings via tube conduits in order to determine the pressure of the fluid and of the surrounding medium or surroundings alternately or in succession. For this one may provide suitable switch valves in the tube conduits in order to impinge the pressure sensor alternately with the fluid pressure and with the pressure of the surrounding medium.

The pressure sensor, for detecting the pressure of the surroundings at the one point in time is preferably brought into a position above the surface of the fluid to be delivered. This may be effected by movement of the pressure sensor or a change of the fluid level. If the sensor is arranged above the fluid level it is located outside the fluid in the surroundings and here may determine the pressure of the surroundings.

Accordingly the pressure sensor preferably for detecting the pressure of the fluid to be delivered at the other point in time is brought into a position below the surface of the fluid to be delivered. In this position the pressure sensor is submersed into the fluid and may determine the fluid pressure.

Preferably for determining the pressure of the surroundings the fluid level is lowered below the level of the pressure sensor and the pressure sensor detects the pressure of the surroundings for correcting the pressure value detected in the fluid. The lowering of the fluid level below the level of the pressure sensor is preferably effected by the pump itself. For this the pump is activated by a control means such that at a predefined point in time at which the pressure of the surroundings is to be determined, it pumps away the fluid to the extent that the pressure sensor is pumped free and the pressure of the surrounding medium or the pressure of the surroundings may be determined outside the fluid. This method permits the application of only one pressure sensor for determining the pressure of the surrounding medium and of the fluid pressure without complicated and long connection conduits being necessary, which connect the pressure sensor to the surrounding medium and the fluid to be delivered. Indeed in contrast, for determining the pressure of the surroundings, the pressure sensor is laid free temporarily by pumping away the fluid.

After reaching the level of the pressure sensor the fluid level is preferably lowered to a predefined value below the level of the pressure sensor. In this manner it is ensured that the pressure senor is indeed located outside the fluid and may determine the pressure of the surrounding medium without any errors. Whether the level of the pressure sensor is reached or fallen short of may be ascertained in that on lowering of the fluid level the pressure detected by the pressure sensor firstly drops and then remains constant on reaching the level of the pressure sensor.

For this the fluid level after reaching the level of the pressure sensor is preferably further lowered during a period of time. Thus a pump may, for example, be controlled such that after reaching the level of the pressure sensor it still runs for a predefined time duration so that it is ensured that the pressure sensor is laid free for determining the pressure of the surrounding medium.

The period of time in which the fluid level is further lowered is preferably calculated on the basis of the lowering speed of the fluid level which has been previously detected by the level sensor. In this manner independently of the size of the pump sump one may ensure that the pressure sensor is laid free in a manner such that the pressure sensor is located above the fluid surface by a predefined amount when determining the pressure of the surrounding medium. Such a predefined distance between the pressure sensor and the fluid surface may thus be maintained without the actual fluid level after falling below of the level pressure sensor having to be determined yet again.

Preferably, the pump is switched off after reaching the level of the pressure sensor after completion of the period of time or on reaching a predefined fluid level below the level of the pressure sensor. It is thus ensured that a pump sump is not pumped completely empty also during the evaluation of the pressure of the surrounding medium, and in particular that the pump does not run dry, which could make a restart of the pump at a later point in time more difficult or even prevent this. It is ensured that the suction port of a pump is always situated below the fluid level.

It is further preferred for the detection of the pressure of the surroundings to be effected only if the fluid level remains below the level of the pressure sensor a predefined period of time. This may be ascertained in that after switching off the pump, the fluid level again rises not too quickly and with at a speed which is not too high. If the fluid level rises too quickly, then it may be the case that the draining of the fluid by pumping away corresponds to the admission into the pump sump so that indeed the fluid level does not fall at all and the sensor accordingly is not pumped free. According to a further preferred embodiment form the pump is started again if the detection of the pressure of the surroundings has not been effected. This means that if it is ascertained that if the correct condition in which the pressure of the surroundings may be determined has not been reached, the pump is started again in order to further reduce the fluid level and to bring the pressure sensor into a position above the fluid level in order to determine the pressure of the surroundings.

A method step for determining the pressure of the surroundings is preferably started if the fluid level begins to sink at a predefined minimum speed. The evaluation of the pressure of the surroundings may thus preferably be started in the manner such that firstly the pump is started in order to reduce the fluid level. If it is now ascertained by the pressure sensor that the measured pressure or the fluid level sinks at a predefined minimum speed the control means induces the previously described procedure for determining the pressure of the surroundings. Since this procedure is only started at a predefined minimum speed, it may be ensured that a drop of the pressure of the surroundings alone does not lead to the start of the procedure for determining the pressure of the surroundings.

Preferably the detection of the pressure of the surrounding medium is effected at predefined, preferably regular points in time. For example the pressure of the surroundings may be determined hourly, wherein afterwards the determined fluid pressure values may be corrected with the determined value of the pressure of the surroundings. The time intervals in which the pressure of the surroundings is determined depend on the speed at which changes of the pressure of the surroundings are to be expected. If quicker changes of the pressure of the surrounding medium are to be expected, then a more frequent determining of this pressure is required in order to guarantee a sufficiently accurate correction of the pressure value determined in the fluid. If only very slow pressure changes are to be expected in the surrounding medium the intervals between the individual pressure measurements in the surrounding medium may be selected longer.

The invention relates further to a pump system with a level sensor which comprises a pressure sensor for determining the absolute pressure. This means that a pressure sensor impinged on one side may be applied. Furthermore the pump system comprises a control means which switches the pump on and/or off in dependence on the readings of the level sensor. The pump according to the invention additionally comprises a calibration means which controls the pump such that for calibration a fluid level is reduced below the level of the pressure sensor so that this detects the pressure of a surrounding medium, e.g. the air pressure. Such a calibration procedure is effected preferably during the running operation at predefined points in time, further preferred at regular intervals in order to correct the pressure readings detected by the pressure sensor in the fluid to be delivered on the basis of the pressure of the surroundings so that on the basis of the pressure difference between the fluid pressure and the pressure of the surroundings one may determine the height of the fluid level above the pressure sensor on running operation in order to accordingly switch the pump on and/or off. The pump according to the invention thus requires no differential pressure sensor and no conduit into the surroundings in order to continuously determine a pressure difference between the surroundings and the fluid. Since the determining of fluid pressure and pressure of the surroundings is not effected at the same point in time, but staggered in time, it is possible to apply one and the same pressure sensor for determining the pressure of the surroundings and of the pressure of the fluid to be delivered. For determining the pressure of the surroundings only the pressure sensor which in normal operation is located in the fluid is pumped free as described above.

Preferably the level switch, the control means and the calibration means are an integral part of a pump unit. In this manner one creates a pump unit which is simple to install and assemble since all control and measurement means are integrated into the pump unit. All means are preferably integrated into the pump housing so that the pump unit only needs to be inserted or suspended into a pump sump.

The pressure sensor is preferably arranged above the suction port of the pump. In this manner the pump is prevented from running dry whilst pumping free the pressure sensor, which would render more difficult or even prevent the starting of the pump again. It may be ensured that the suction port is constantly situated in the fluid also during the evaluation of the pressure of the surroundings, when the fluid level is lowered below the level of the pressure sensor.

The pressure sensor is preferably attached on the stator housing or pump housing. This simplifies the assembly since the pressure sensor does not need to be fastened separately from the pump at a predefined position in the pump sump. The sensor is always located at a predefined position relative to the suction port of the pump. If the pressure sensor is rigidly connected to the stator housing or pump housing or is attached to these, then for the application of the pump it is merely necessary to insert this into the pump sump.

It is further preferred for a control means comprising the calibration means to be arranged in a terminal box or in the pump housing or stator housing. In this manner one creates a compact pump or a compact pump unit into which all control means are integrated so that the connection and starting operation of the pump are simplified.

The pressure sensor is preferably an absolute pressure sensor impinged on one side. This permits a simple and inexpensive design of the pressure sensor. For example a membrane in the pressure sensor may be impinged from one side with pressure, whilst the required electronics for determining the deflection of the membrane may be arranged on the opposite side of the membrane protected from the fluid.

The invention further relates to the use of a pressure sensor impinged on one side in a pump system according to the preceding description, wherein the pressure sensor only has electrical connection leads at its disposal. With known differential pressure sensors it is necessary to lead a flexible tubing conduit to the surface above the fluid level in order to impinge the differential pressure sensor from one side with the pressure of the surroundings. According to the method according to the invention and the pump system according to the invention this is no longer required, but one may rather use a pressure sensor impinged on one side in the pump system according to the invention.

These and other objects and advantages of the invention will be apparent from the following description, the accompanying drawings and the appended claims.

BRIEF DESCRIPTION OF THE DRAWINGS

Hereinafter the invention is described by way of example by way of the attached figures. In these there are shown in FIG. 1 a diagram which shows the course of a correction procedure, and FIG. 2 a diagram which shows the course with which no correction is carried out.

DETAILED DESCRIPTION OF THE INVENTION

The method according to the invention and in particular the pump system according to the invention may be applied wherever a differential pressure between a fluid and a surrounding medium needs to be determined for measurement or control purposes. The method is preferably applied to a pump with which the fluid level is detected via a pressure sensor in order to switch the pump on and/or off. In order to be able to determine the exact fluid level it is necessary to determine the differential pressure between a pressure at a certain height in the fluid and the pressure of the surroundings, since otherwise fluctuations of the pressure of the surroundings would influence the determined value for the fluid or liquid level. According to the method according to the invention, for this, the pressure of the surroundings and the pressure in the fluid are not determined simultaneously but at different points in time in succession.

With a submersible pump as for example is applied for reducing the groundwater or in waste water wells, for this, at predefined points in time the fluid level is lowered by the pump to the extent that the pressure sensor serving as a level sensor is pumped free, i.e. is located above the fluid level. In this condition the pressure sensor determines the pressure of the surroundings, i.e. the air pressure. Subsequently the pump sump runs full again and the pressure sensor lies again below the fluid level so that it detects the hydrostatic pressure which is caused by the fluid lying above it. Since the pressure of the surroundings has been previously determined, the differential pressure between the pressure detected in the fluid and the pressure of the surroundings may be determined so that the hydrostatic pressure caused by the fluid alone is detected and thus one may determine the height of the fluid level in order to determine the time of switching the pump on and/or off.

An absolute pressure sensor is applied as a pressure sensor which is impinged on one side.

Figure 1:
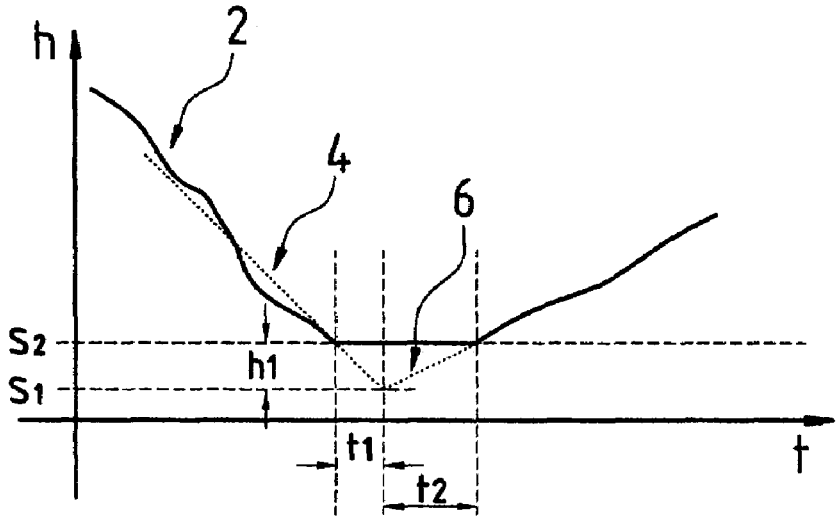

By way of FIG. 1 the course of a correction procedure, i.e. the course of determining the pressure of the surroundings is described in more detail. In FIG. 1 the height h of the fluid level in the pump sump or the pressure detected by the pressure sensor is plotted over the time t. The unbroken line 2 shows the course of the signal emitted by the pressure sensor over time. Firstly the pumping-away procedure is started so that the fluid level 2 or the pressure signal 2 representing the fluid level falls, until the fluid level has reached the value $S_2$. The value $S_2$ corresponds to the height $S_2$ at which the pressure sensor is attached on the pump. During this pumping procedure the control means of the pump detects an average lowering speed which is represented in the diagram according to FIG. 1 as a dotted line 4. If the fluid level has reached the level S2 of the pressure sensor and subsequently falls short of this, the pressure sensor detects the pressure of the surroundings so that the pressure detected by the pressure sensor does not drop any further. Since the control means determines the fluid level in the pump sump via the detected pressure, at this point in time due to the constant pressure the fluid level appears to be constant to the control means, which is represented by the horizontal course of the graph 2 in FIG. 1 at the height $S_2$ during the time intervals $t_1$ and $t_2$.

During the preceding pumping-away procedure, the average sinking speed of the fluid level dh/dt shown by the dotted line 4 is determined. In order to be able to ensure a perfect evaluation of the pressure of the surroundings, the fluid level should be lowered below the level $S_2$ to the level $S_1$. In order to reach the level $S_1$ thus the fluid level proceeding from the level $S_2$ must still be lowered by the height $h_1$. On account of the previously evaluated sinking speed dh/dt one may now determine the period of time $t_1$ in which the pump must run further with a constant power so that with a constant sinking speed the fluid level is lowered to the level $S_1$ by the measure $h_1$. The following applies:

$$t_1=h_1/(dh/dt)$$

After completion of the period of time $t_1$ the pump is switched off and the fluid level in the interval $t_2$ increases again until it has again reached the level $S_2$. On exceeding the level $S_2$ the control of the pump again detects a pressure change, and the detected signal for the fluid level which is represented by the unbroken line 2 in FIG. 1 again rises after completion of the interval $t_2$.

In the interval $t_2$ the measurement of the pressure of the surrounding is carried out provided that the interval $t_2$ is longer than a predefined interval $t_2$ min. If the sensor signal remains constant at the value $S_2$ for a shorter time period than $t_{2min}$, then it is the case of the fluid admission into the pump sump compensating the fluid discharge due to the pumping-away procedure by the pump, so that the fluid level remains constant. In this condition the fluid sensor is not pumped free although it does not detect any further change of the pressure. Thus at this point in time one may not carry out a measurement of the pressure of the surroundings. If however the sensor signal remains constant at the value $S_2$ in a period of time $t_2>t_{2min}$, it may be assumed that the fluid level has been lowered to below the level $S_2$ of the sensor and the sensor at this point in time is thus free, i.e. lies outside the fluid or the liquid and may detect the pressure of the surroundings.

Subsequent to determining the pressure of the surroundings the pump sump runs full again, and subsequently detected pressure values may be corrected on the basis of the pressure of the surroundings. The detection of the pressure of the surroundings is effected at predefined points in time, for example on an hourly basis. Since changes of the pressure of the surroundings are effected considerably slower or sluggishly than changes in the fluid level, individual measurements of the pressure of the surroundings at predefined time intervals are sufficient in order to correct the pressure detected in the liquid or fluid in order to be able to determine the exact height of the fluid level. The fluid level is proportional to the differential pressure between the fluid pressure and the pressure of the surroundings.

Figure 2:
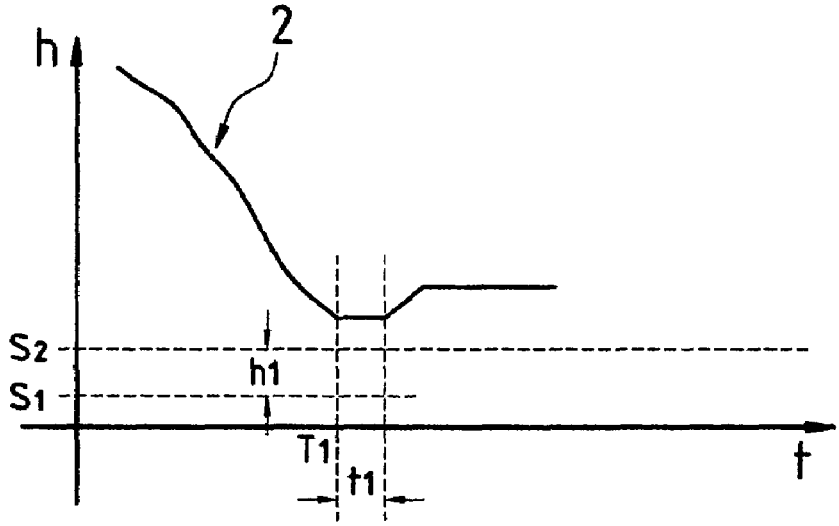

FIG. 2 shows a diagram which corresponds to FIG. 1 and which illustrates a further condition in which no measurement of the pressure of the surroundings has been carried out. As described by way of FIG. 1, firstly the fluid level is lowered by starting the pump, which is detected by the pressure sensor which emits a signal level 2. At the point in time $T_1$ the signal 2 in the vicinity of the level $S_2$ of the sensor remains constant. This causes the control means firstly to assume that the level $S_2$ is reached or fallen short of, so that the sensor is pumped free. As a result it now evaluates, as explained by way of FIG. 1, the interval $t_1$ in which the pump must continue to run in order to lower the fluid level by the predefined amount $h_1$. The pump is switched off after completion of the period of time $t_1$. In the case shown in FIG. 2 now after completion of the interval $t_1$ the signal directly increases again. The signal level 2 thus does not remain constant for a period of time $t_2>t_{2min}$. From the direct increase again of the signal level one may now conclude that indeed the liquid level has not been lowered below the level $S_2$ but that merely an admission into the pump sump has corresponded exactly to the quantity of fluid or liquid pumped away by the pump so that the signal level 2 was constant in the interval $t_1$. Due to the increase again of the signal level 2 before completion of the period of time $t_{2min}$ the control means now recognizes an error and does not carry out an evaluation of the pressure of the surroundings, but again starts the pump in order to start the described procedure from the beginning and to determine the pressure of the surroundings.

By way of the previously described method, without additional sensors one may exactly determine that condition in which the pressure sensor is pumped adequately free in order to determine the pressure of the surroundings. Alternatively for example a second sensor in the form of a pressure sensor or another level or moisture sensor may be provided which detects whether the pressure sensor used for the pressure measurement is located above or below the fluid level. This is important in order to be able to determine the pressure of the surroundings and the pressure in the fluid at different points in time with one and the same sensor, and to be able to correct the pressure measured in the fluid on the basis of the pressure of the surroundings or to be able to determine the differential pressure. Alternatively for example in the region of the upper end of a submersible pump one may arrange a pressure sensor for determining the pressure of the surroundings after a lowering of the fluid level, and in the region of the lower end of the submersible pump there may be arranged a further pressure sensor for determining the fluid pressure. With this arrangement too the pressure measurement of the pressure of the surroundings and of the fluid pressure at two different points in time means that it is not necessary to keep the pressure sensor constantly above the fluid level for determining the pressure of the surroundings, which would require additional connection conduits.

While the system and method described, constitute preferred embodiments of this invention, it is to be understood that the invention is not limited to this precise system and method, and that changes may be made in either without departing from the scope of the inventions, which is defined in the appended claims.

What is claimed is:

1. A method for correcting a pressure value in a level sensor of a submersible pump wherein there is provided a pressure sensor serving as said level sensor and at one point in time as a first pressure value the pressure of the surroundings is detected by said pressure sensor and at another point in time as a second pressure value the pressure of the fluid to be delivered by the pump is detected by said pressure sensor, and wherein said second pressure value is corrected on basis at said first pressure value by evaluating the pressure difference between the second and first pressure value.

2. The method according to claim 1, with which said pressure sensor for detecting the pressure of the surroundings at the one point in time is brought into a position above the surface of the fluid to be delivered.

3. The method according to claim 2, with which for determining the pressure of the surroundings the fluid level is lowered below the level ($S_2$) of said pressure sensor, and said pressure sensor detects the pressure of the surroundings for correcting the pressure value detected in the fluid at said other point in time.

4. The method according to claim 3, with which after reaching the level ($S_2$) of said pressure sensor the fluid level is lowered to a predefined value ($S_1$) below the level ($S_2$) of said pressure sensor.

5. The method according to claim 4, with which the fluid level after reaching the level ($S_2$) of said pressure sensor is further lowered for a period of time ($t_1$).

6. The method according to claim 5, with which the period of time is computed on the basis of the sinking speed (dh/dt) of the fluid level previously detected by the level sensor.

7. The method according to claim 4, with which the pump is switched off after reaching the level ($S_2$) of said pressure sensor after completion of the period of time ($t_1$) or on reaching a predefined fluid level ($S_1$) below the level ($S_2$).

8. The method according to claim 2, with which said pressure sensor for detecting the second pressure of the fluid to be delivered at the other point in time is brought into a position below the surface of the fluid to be delivered.

9. The method according to claim 1, with which the said pressure sensor for detecting the pressure of the fluid to be delivered at said other point in time is brought into a position below the surface of the fluid to be delivered.

10. The method according to claim 9, with which said pressure sensor for determining the pressure of the surroundings the fluid level is lowered below the level ($S_2$) of said pressure sensor and said pressure sensor detects the pressure of the surroundings for correcting the pressure value detected in the fluid.

11. The method according to claim 1, with which the detection of said pressure of the surroundings is only effected if the fluid level remains below the level ($S_2$) of said pressure sensor for a predefined period of time ($t_2$).

12. The method according to claim 11, with which the pump is started again if a detection of the pressure of the surroundings is not effected.

13. The method according to claim 1, with which a method step for evaluating the pressure of the surroundings is started if the fluid level begins to sink at a predefined minimum speed.

14. The method according to claim 1, with which a detection of the pressure of the surrounding medium is carried out at predefined, preferably regular points in time.

15. A submersible pump system with a fluid level sensor which comprises a pressure sensor for determining an absolute pressure, and control means which switches the pump on and/or off in dependence on the readings of the fluid level sensor, wherein the pump comprises a calibration means for correcting a second pressure value detected in a fluid on the basis of a first pressure value detected in the surroundings, wherein at one point in time said pressure sensor detects said first pressure value and at another point in time detects said second pressure value, and wherein said second pressure value is corrected on the basis of the first pressure value by evaluating the pressure difference between said second pressure value and said first pressure value.

16. The pump system according to claim 15, with which the fluid level sensor, the control means and the calibration means are an integral component of a pump unit.

17. The submersible pump system according to claim 15, with which said pressure sensor is arranged above the suction port of the pump.

18. The pump system according to claim 15, with which said pressure sensor is an absolute pressure sensor.

19. The use of a pressure sensor in a pump system according to claim 15, wherein said pressure sensor only has electrical connection conduits.

* * * * *